United States Patent [19]

Roeder et al.

[11] 3,974,878

[45] Aug. 17, 1976

[54] METHOD AND APPARATUS FOR ARTIFICIAL LIFT FROM MULTIPLE PRODUCTION ZONES

[76] Inventors: George K. Roeder, P.O. Box 4335, Odessa, Tex. 79760; Raymond Hardy, W. Star Rte., Box 740, Lovington, N. Mex. 88260

[22] Filed: Sept. 12, 1975

[21] Appl. No.: 612,870

[52] U.S. Cl. ..... 166/314; 166/106; 166/105.5

[51] Int. Cl.[2] ..... E21B 43/00; E21B 39/00

[58] Field of Search ..... 166/106, 68.5, 105.5, 166/314, 313; 417/391, 403, 404

[56] References Cited

UNITED STATES PATENTS

| | | | |
|---|---|---|---|
| 2,242,166 | 5/1941 | Bennett | 166/106 X |
| 2,338,903 | 1/1944 | Coberly | 166/68.5 X |
| 3,170,520 | 2/1965 | Arutunoff | 166/106 X |
| 3,453,963 | 7/1969 | Roeder | 417/404 |
| 3,517,741 | 6/1970 | Roeder | 166/106 |
| 3,559,740 | 2/1971 | Scaggs | 166/106 X |
| 3,625,288 | 12/1971 | Roeder | 166/68.5 X |
| 3,703,926 | 11/1972 | Roeder | 166/106 |
| 3,833,060 | 9/1974 | Craggs et al. | 166/106 X |
| 3,865,516 | 2/1975 | Roeder | 417/403 |
| 3,894,583 | 7/1975 | Morgan | 166/106 X |

*Primary Examiner*—Stephen J. Novosad
*Attorney, Agent, or Firm*—Marcus L. Bates

[57] ABSTRACT

A relatively large power fluid tubing is run downhole and connected to a relatively small power fluid tubing. The small power fluid tubing is connected to the valve assembly of a downhole pump. The small diameter tubing and pump is enclosed within a production tubing having the lower end thereof sealed to the pump inlet, with the lower end of the pump being placed in fluid communication with formation fluid. The upper end of the production tubing is vented and supported from the relatively large diameter power fluid tubing. A packer is disposed below the vent. Production from the pump occurs through an annulus which is formed between the small power tubing and the production tubing. Produced fluid from the pump flows through the annulus, through the vent, and up through the borehole annulus, while power fluid flows to the valve assembly of the pump engine by means of the series connected large and small power fluid tubing.

15 Claims, 13 Drawing Figures

METHOD AND APPARATUS FOR ARTIFICIAL LIFT FROM MULTIPLE PRODUCTION ZONES

PRIOR ART

| | |
|---|---|
| Roeder | 3,517,741 |
| Roeder | 3,865,516 |
| Roeder | 3,650,640 |
| Roeder | 3,625,288 |
| Roeder | 3,703,926 |
| Roeder | 3,453,963 |

BACKGROUND OF THE INVENTION

Hydraulically actuated downhole pumps which must be positioned in extremely deep wells require that slim pumps be used because of the small borehole diameter. The extreme depth of the borehole demands a long string of tubing be connected to the pump; and therefore, the tubing is made as lightweight as possible. The small size of the tubing precludes the suspension of excessive or improper loads thereon; and therefore, from time to time, the tubing will break; thereby bringing about an extremely expensive fishing job.

It would accordingly be desirable to have a downhole hydraulically actuated pump system arranged to satisfactorily employ lightweight small power fluid tubing, which is supported in a manner which prevents the loads imposed thereon from exceeding its structural integrity.

Moreover, it would be desirable if such an assembly could be arranged in a manner whereby the lightweight power fluid tubing could be removed from the borehole for inspection. It would furthermore be desirable to have means by which the lightweight power tubing could be pulled dry.

SUMMARY OF THE INVENTION

The present invention provides an artificial lift apparatus for use in deep boreholes, comprising a hydraulically actuated pump assembly flow connected to a power fluid tubing of different diameters, such that the lowermost smaller i.d. (inside diameter) tubing can be pulled in a telescoping manner through the upper larger i.d. tubing to enable inspection and replacement thereof. The larger i.d. tubing extends downhole through the larger portion of the borehole, and diminishes in size for accommodation within the smaller i.d. portion of the borehole. The larger i.d. power fluid string supports a lower production tubing string of limited strength. The production tubing encloses the small i.d. power fluid tubing and forms an annular flow passageway therebetween, through which produced fluid can flow uphole toward the surface of the earth.

The upper extremity of the production tubing is vented, and a packer is interposed between the production tubing and the borehole wall so that the pump can be placed with the inlet thereof being located below the formation fluid level. Flow of production fluid can accordingly occur up the lower annulus, through the packer, out through the vent, and up the borehold annulus to the surface of the ground. At the same time, power fluid flows in a countercurrent direction respective to the production fluid, so that the pump engine is provided with a suitable source of power.

A seal bowl assembly is utilized for connecting the small i.d. power tubing to the large i.d. power tubing, such that the upper extremity of the small i.d. tubing is removably and supportingly received thereby. The upper vented portion of the production tubing is also connected to the seal bowl assembly, and at least partially supported thereby. This expedient enables the relatively large size power tubing to support the entire weight of the pump, production tubing, and small power tubing.

A stab-in valve assembly connects the production tubing and small power tubing to the pump assembly, and a valve is incorporated therein which enables lateral flow from the interior of both the power tubing and the production tubing to occur when the small power tubing is lifted from seated relationship therewith.

In one of the preferred embodiments of the invention, the production tubing enlarges in diameter at the stab-in valve assembly, thereby enabling a relatively small production tubing to be employed. The stab-in valve assembly therefore provides a means by which the production tubing can be made to form a housing which extends downhole about the pump assembly.

The lower extremity of the housing terminates in a shoe, which sealingly receives the lowermost inlet end of the pump. The shoe is provided with a stinger, or extension, which insures that the inlet of the pump is maintained below the formation fluid level of the borehole.

Accordingly, a primary object of this invention is the provision of method and apparatus for producing deep wells wherein extremely long lengths of tubing must be connected downhole to a hydraulically actuated pump assembly.

Another object of the invention is to provide a concentric countercurrent flow system for a downhole hydraulically actuated pump, by the provision of a single power fluid conveying pipe at the upper marginal length of the borehole, and a lightweight, removable, power fluid conveying pipe supported within a production string at the lower marginal length of the borehole.

A further object of this invention is to disclose and provide a flow system for a deep well hydraulically actuated pump wherein an upper, relatively large power fluid tubing is supportingly connected to a lower, relatively small power fluid tube which extends downhole to a pump located at a great depth.

A still further object of this invention is to provide a relatively large power fluid tubing which supports a production tubing and a pump housing, and within which there is disposed a pump and a relatively smaller, removable power fluid tubing.

Another and still further object of the present invention is the provision of a method of producing extremely deep wells wherein the tubing weight is distributed such that the structural integrity thereof is never exceeded.

An additional object of this invention is to disclose and provide a method by which a deep slim well can be produced while using a reduced amount of relatively small tubing.

Another object of the invention is to provide a method by which multiple production zones may be produced with a single pump, wherein the pump inlet is located below the formation fluid level of the lowermost production zone.

A further object of this invention is to disclose and provide a method of producing a deep well wherein the gas reservoir is advantageously increased in volume.

A still further object of this invention is the provision of a gas escape means for use in conjunction with a hydraulically actuated pump disclosed in deep wells.

A still further object of this invention is to provide a deep well production apparatus which includes a cross-over means by which produced fluid is transferred from a production string annulus into a borehole annulus.

These and various other objects and advantages of the invention will become readily apparent to those skilled in the art upon reading the following detailed description and claims and by referring to the accompanying drawings.

The above objects are attained in accordance with the present invention by the provision of both method and apparatus for producing artificial lift from multiple production zones in a manner substantially as described in the above abstract and summary.

DETAILED DESCRIPTION OF THE PREFERRED EMBODIMENT

Figure 1:
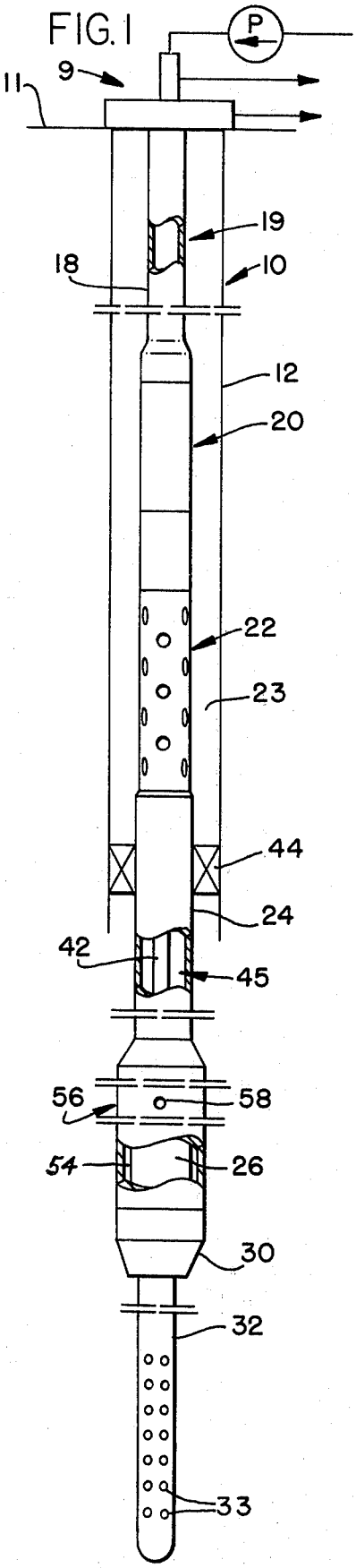
FIG. 1 is a part diagrammatical, part schematical, part cross-sectional representation of the present invention, illustrated in its operative configuration.
Figure 4:
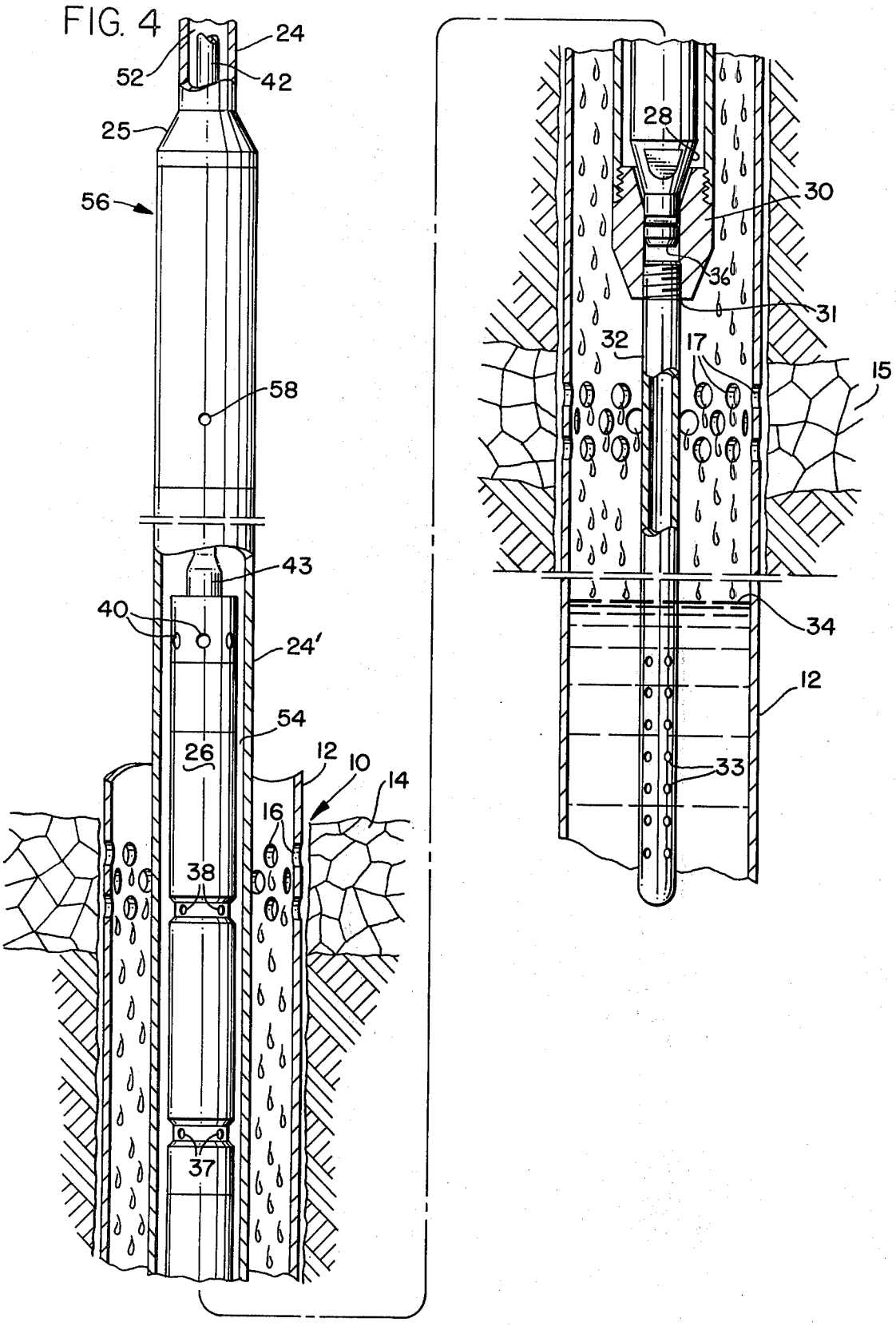
FIG. 4 is a fragmentary, more detailed, part cross-sectional view of still another part of the apparatus disclosed in FIG. 1.

In FIG. 1, there is schematically disclosed a Christmas tree 9, which forms the upper extremity of an oil well. The oil well comprises a borehole 10 which extends downhole far below the surface of the earth 11. The borehold is usually cased, as indicated by the numeral 12; and, as seen in FIG. 4, communicates with one or more oil producing stratas or formations 14 and 15 by means of perforations 16 and 17. The perforations are formed within the sidewall of the casing in the usual manner. Often a plurality of other formations also communicate with the interior of the cased borehole by means of similar perforations.

An upper large power tubing 18 is suspended from the Christmas tree, and as seen at 19, the tubing is provided with a hollow interior and has no additional piping contained therewithin.

Figure 2:
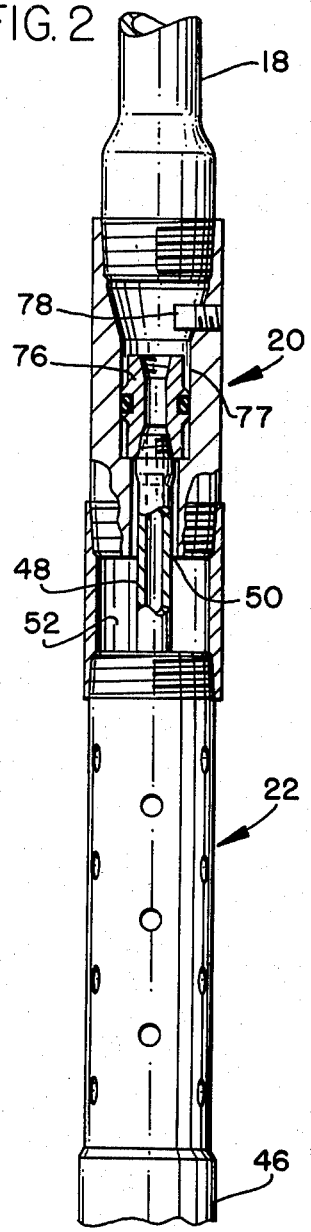
FIG. 2 is a broken, enlarged, part cross-sectional elevational view of part of the apparatus disclosed in FIG. 1.

As best seen disclosed in FIGS. 1, 2, and 4, a seal bowl assembly 20 is connected to the lower end of the upper power tubing and to the upper end of a vent string 22. Annulus 23 is formed between the large power tubing and the casing to provide an annular flow path from the vent string up to the Christmas tree.

Lower production tubing 24 is connected to the vent string and enlarges at the lower end 25 thereof to form a tubular housing within which a pump is enclosed; hence, the housing actually forms a lower enlarged marginal end portion of the tubing 24.

As seen disclosed in FIG. 4, a downhole hydraulically actuated pump assembly 26, such as set forth in applicant's previously issued patents referred to above, is provided with a production fluid inlet at 28, which sealingly engages a pump seating shoe 30 in a removable manner. A tailpipe or stinger 32 downwardly depends from the shoe, and is provided with a plurality of perforations 33 at the lower marginal end thereof, so that the perforations are maintained below the production or formation fluid level 34, thereby assuring a supply of formation fluid for the pump inlet 36.

The pump is provided with the usual production outlets 37, 38, and a spent power fluid outlet 40, so that power fluid which previously has flowed through the power fluid tubing 42 can actuate the pump engine, which in turn actuates the production pump to thereby cause fluid from the various formations to be produced.

The lower or relatively small power tubing 42 is provided with a connection 43 by which power fluid is transferred into the valve assembly of the pump where power is extracted from the fluid in a manner known to those skilled in the art.

Figure 3:
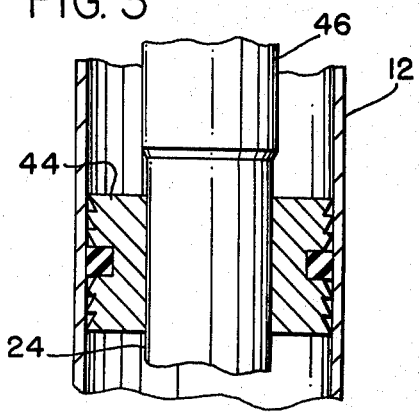
FIG. 3 is an enlarged, fragmentary, part cross-sectional view of part of the apparatus disclosed in FIG. 1.

Packer 44 is of conventional design and is series connected into the production tubing where it effectively seals the casing annulus at the illustrated position between the casing and the tubing in the illustrated manner of FIGS. 1 and 3.

As best seen in FIG. 2, the upper marginal extremity 48 of the small power tubing is received through axial bore 50 and is seated within the seal bowl assembly. The entire length of the small tubing is concentrically arranged respective to the vent string 22 and to the production string 24, thereby forming an annular flow path 52 therebetween.

An annulus 54 is also formed between the pump and the pump housing, with the lower end of the annulus commencing at the shoe and extending up the production tubing at 52, where it is placed in communication with the radial ports of the vent string.

Figure 5:
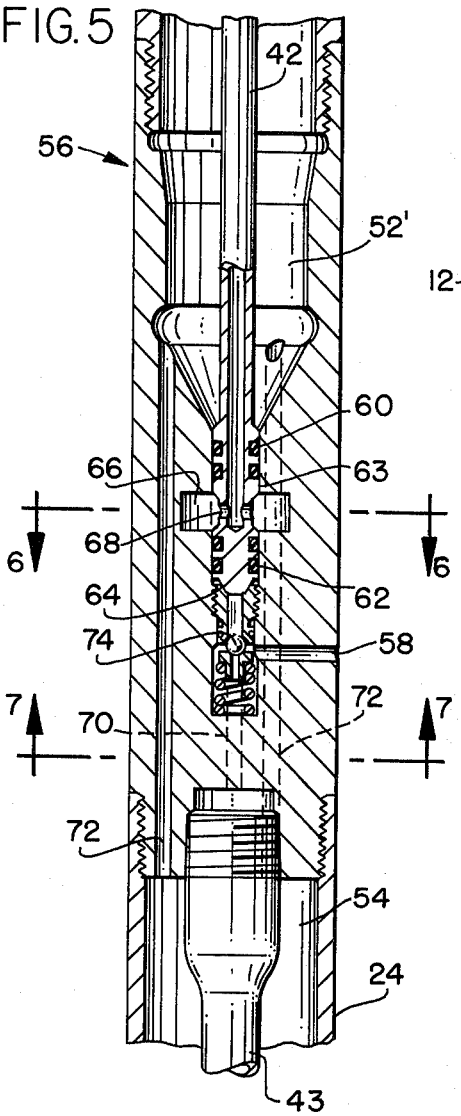
FIG. 5 is an enlarged, fragmentary, longitudinal, part cross-sectional view of part of the apparatus disclosed in FIG. 4.
Figure 6:
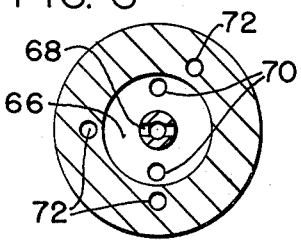
FIGS. 6 and 7, respectively, are cross-sectional views taken along lines 6—6 and 7—7, respectfully, of FIG. 5.
Figure 7:
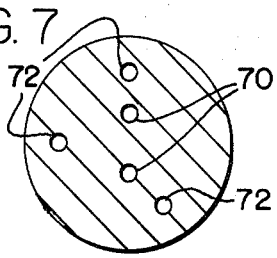

FIG. 5 discloses a stab-in valve assembly 56 which is series connected respective to the pump housing, the production tubing, the pump inlet, and the small power tubing. The stab-in valve assembly is provided with a port 58 which forms a lateral flow path. The lateral flow path is placed in communication with an annulus 52′ when the small power tubing is removed from seated engagement with the stab-in valve assembly.

The small power tubing is provided with spaced seal assemblies at 60 and 62 which sealingly engage the spaced axially aligned bores 63 and 64. Annular cavity 66 is in fluid communication with port 68, while the last named port is seen to be in fluid communication with the interior of the small hollow power tubing.

Radially spaced angled passageway 70 communicates the power fluid inlet 43 with the annular chamber 66, thereby forming a fluid flow path which extends from the power tubing at 42 to the valve apparatus of the pump engine. Longitudinal flow passageways 72 are formed through the stab-in valve assembly and communicate annulus 52' with annulus 54, thereby providing a flow passageway which enables produced fluid to flow from the pump outlets 37, 38, up through the pump production annulus 54, through the stab-in valve assembly, into the annulus 52', and up to and through the ports formed in the vent string, where fluid can then flow up through the borehole annulus 23 and to the Christmas tree.

A ball type valve 74 is spring loaded so that flow can occur from chamber 66 outwardly through port 58 when the small power tubing is removed from its seated relationship respective to the stab-in valve assembly. Flow cannot occur in the reverse direction.

Looking again to the details of FIG. 2, there is disclosed a seal insert 76 which is affixed to the upper terminal end of the small power tubing, and which removably and sealingly engages an axial counterbore 77 formed within the seal bowl assembly. The seal insert is provided with the illustrated lower shoulder, which supportingly engages the shoulder mutually formed at the joinder end of the counterbores 50 and 77. The upper marginal interior surface of the insert is threaded so that it can be suitably engaged with a known fishing tool, thereby enabling the insert to be lifted upwardly from its cavity 77, carrying therewith the entire string of small power tubing. This action simultaneously unseats the enlargement 63 and 64 from the stab-in valve assembly. Knockout plug 78, of conventional design, can be ruptured so that fluid is drained from the large power tubing when it is desired to do so.

Figure 8:
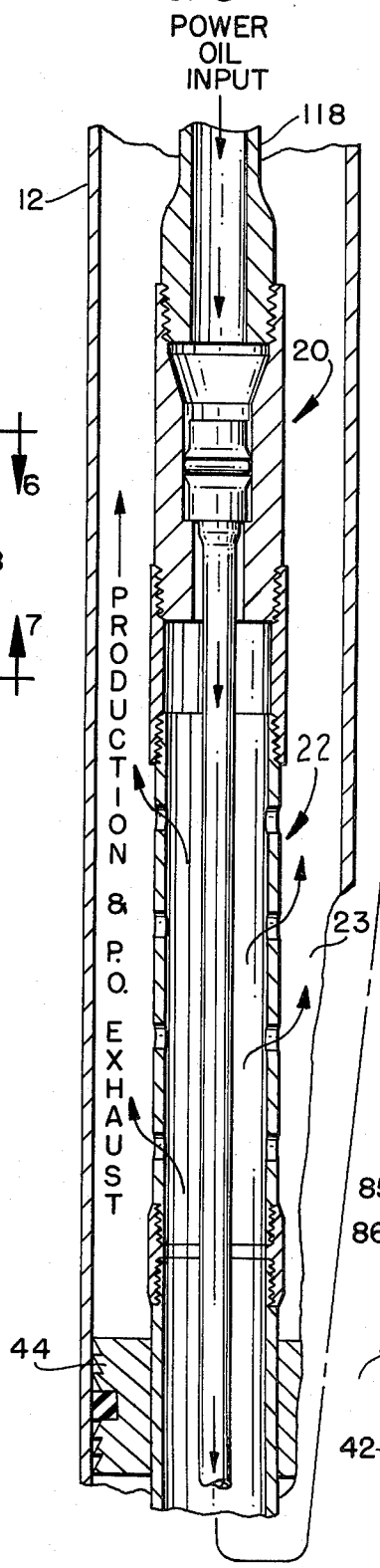
FIG. 8 is a broken, longitudinal, part cross-sectional view showing a gas escape valve which forms a part of the present invention.
Figure 8:
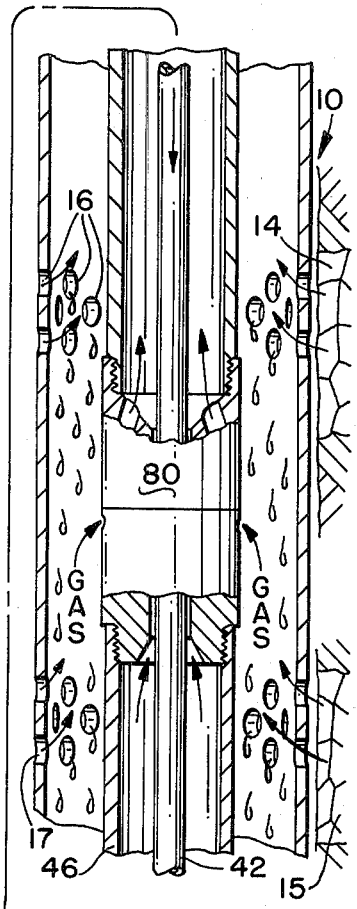
Figure 9:
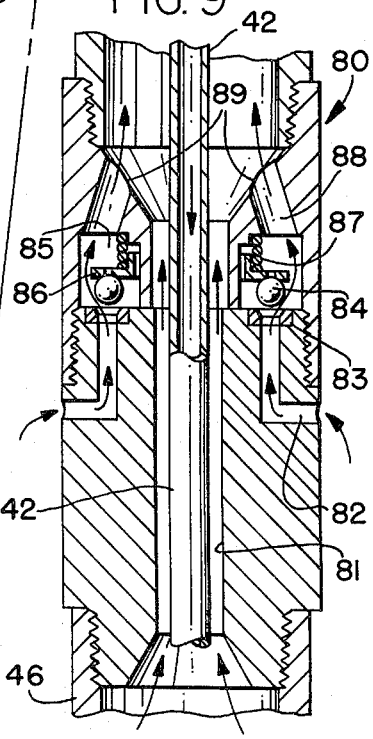
FIG. 9 is an enlarged, more detailed, part cross-sectional view of part of the apparatus disclosed in FIG. 8.
Figure 10:
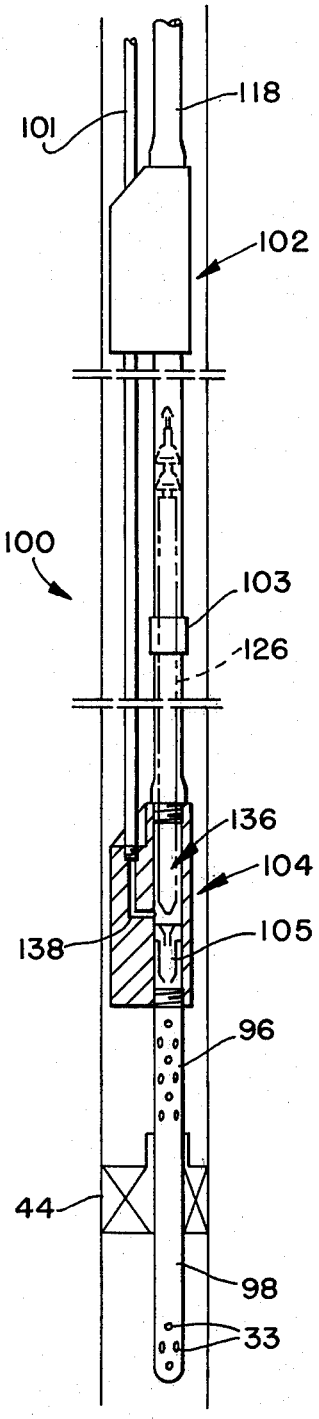
FIG. 10 is a broken, part diagrammatical, longitudinal, part cross-sectional view of another form of the invention.
Figure 11:
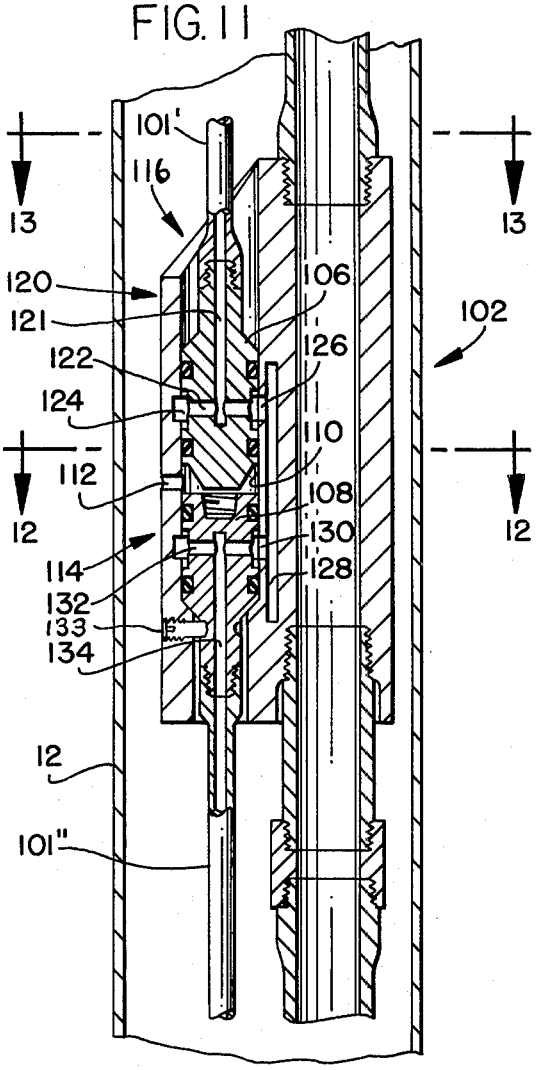
FIG. 11 is an enlarged, part cross-sectional, broken view of part of the apparatus seen disclosed in FIG. 10; and, FIGS. 12 and 13 are cross-sectional views taken along lines 12—12 and 13—13 of FIG. 11.
Figure 12:
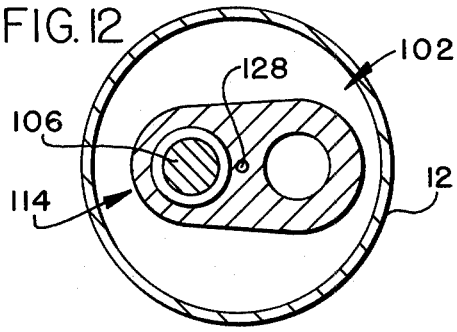
Figure 13:
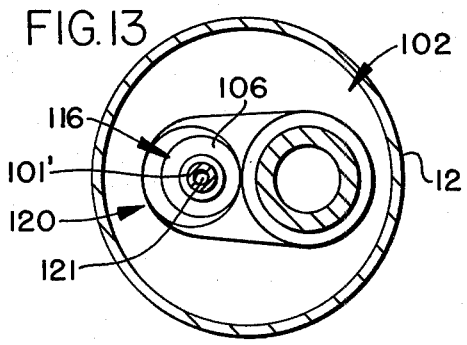

As seen illustrated in FIG. 8 and FIG. 9, a gas escape valve 80 may be placed in underlying relationship respective to the packer 44, with the gas escape valve being connected in series relationship respective to the production tubing, and with there being an axial passageway 81 formed therethrough, thereby forming an annulus between the small power tubing and the axial longitudinal passageway through which production fluid can flow. Radially spaced ports 82 are connected downstream of the illustrated valve seats 83 leading to the interior of the annulus 85. Balls 84 are held seated by ring 86. The ring is biased by springs 87. Hence the ball check valves permit flow to occur from the borehole annulus into the production annulus by by means of passageways 82 and 88.

The gas escape valve permits accumulated gas underlying the packer to flow into ports 82, across the valve means 84–87, through passageway 88, and into the production annulus at 89.

The flow continues up the production tubing annulus and through the ports of the perforated nipple, where the gas can then continue to flow uphole through the casing annulus to the surface of the ground. The radially spaced-apart ball check valves can be preloaded to a suitable predetermined magnitude, depending upon the history of the borehole, so that the annulus located below the packer is cyclically unloaded as may be required to maintain the pressure effected below the packer at an optimum production value.

As fluid is produced from the hydrocarbon-bearing zones 14 and 15, a fluid level 34 will be effected somewhere downhole in the borehole within the casing. Perforations 33 are positioned so that they always remain below this fluid level.

Power fluid is pumped downhole by means of the large power tubing, through the seal bowl assembly, and into the small power tubing, through the stab-in valve assembly, and into the power fluid inlet 43, where the power fluid then flows to the engine valve assembly which regulates flow of power fluid to the pump engine. The engine reciprocates, causing formation fluid to flow into the pump inlet 36, with the production fluid exhausting through exhaust ports 37 and 38. The production fluid comingles with the spent power fluid and flows up through the pump production annulus 54, through radial port 72, into annulus 52', up through the lower annulus 52, and out through the vented portion of the production tube. The fluid continues to flow uphole by means of upper annulus 23, where it is received at the Christmas tree and directed to a gathering system.

As gas accumulates below the packer 44, the gas escape valve will allow a reduction in the gas pressure by flowing gaseous products through the gas escape valve and into the production tubing annulus, where the gaseous products flow along with the production fluid in the before described manner.

Should the production rate diminish, a fishing tool can be run downhole into engagement with the seal insert 76, whereupon the small power tubing can be lifted up through the large power tubing and removed from the wellbore for inspection and replacement as may be required. The small tubing is pulled dry, because as the tube is lifted from the stab-in valve assembly, flow into the pump production annulus can occur across valve 74 and through outlet ports 58.

In the embodiment of the invention disclosed in FIGS. 10–13, there is seen a bottom hole assembly 100 for receiving a free type hydraulically actuated pump therein. The assembly is comprised of a lower production string 101 which is removably received within a stab-in receptacle 102. O-ring collar 103 underlies the receptable and is spaced from a pump receiving shoe 104. The shoe includes a standing valve assembly 105 made in accordance with my previously issued U.S. Pat. No. 3,865,516, to which reference is made for more specific details thereof.

The lower production tubing is comprised of a string made up of individual joints, with each joint having similar opposed end portions 106 and 108 in the form of a seal member. Each seal member is of a size to be sealingly received within a counterbore 110. Port 112 vents the annulus formed between the abutting enlargements to thereby enable the enlarged seal members to be placed within the counterbore without encountering hydraulic or pneumatic pressure as the piston-like enlargements are brought into engagement with one another.

The stab-in receptable preferably is built into a unitary body having an eccentric side 114 which upwardly slopes at 116, thereby providing a guide means which enhances locating the enlargement 106 within its attendant counterbore, and thereafter enhances positioning of a fishing tool within operative overlying relationship respective to the member 108.

Individual joints of power fluid tubing 118 can be connected together in the usual manner with a plurality of stab-in receptacles being spaced along the power tubing string at intervals which lend adequate support to the production tubing 101. The outermost surface area of the receptable preferably is spaced from the wall of the casing sufficiently to leave the power tubing string in longitudinal alignment respective to its axial centerline.

The production tubing 101 is provided with a seal means 106 and 108 at each extremity thereof, with the power tubing being series connected tobether by a stab-in receptacle as indicated at 101, 101', and 101''.

Each of the seal members includes an axial passageway 121 which terminates within an opposed seal means 106 and 108. The seal member is provided with radially spaced ports 122, 132, which are flow connected to a circumferentially extending undercut area 124. The circumferentially extending undercut area is brought into alignment with lateral ports 126 and 130. Ports 126 flow connect the radial port 122 with the passageway 128. Port 130 interconnects passageway 128 with radial port 132, with the last named port being flow connected to axial passageway 134 of the production tubing 101'', for example.

A free type pump can be pumped downhole into seated engagement, as indicated at 136, with respect to the pump receiving shoe. Passageway 138 is connected to the lower annulus formed between the pump and the power fluid tubing, with the annulus extending upwardly to the O-ring collar and downwardly to the standing valve assembly so that produced fluid, intermingled with spent power fluid, can flow down the annulus, through port 138, and up the production tubing 101 where the flow is diverted laterally by means of ports 132 and 130 into passageway 128. The flow continues through ports 126 and 122 into passageway 121 and up the next joint of production tubing 101'. Where deemed desirable, a plurality of stab-in receptacles can be utilized so that the weight of the production tubing never exceeds its designed breaking strength.

The stab-in valve assembly of FIGS. 1, 4, and 5 serves the dual purpose of providing a means for removing the small power tubing, a means for pulling dry tubing, and a reducing coupling by which production tubing at 24 can be enlarged into the illustrated housing 24'.

Those skilled in the art will appreciate that the packer 44 of FIGS. 1, 3, and 8 can be arranged to carry a proportional amount of the load located above and below the packer. However, it must be realized that when it becomes necessary to pull the pump along with its housing, the large power tubing must support the entire load of the pump, pump housing, production tubing, packer, and upper tubing.

The present invention enables a sufficiently large upper power tubing to be employed for supporting all of the above weight, with the seal bowl assembly being employed downhole at an elevation where the cross-sectional area of the borehole demands a reduction in conventional pump size. By utilizing a large upper power tubing as the single fluid conductor, and by incorporating the seal bowl assembly, vent string, and packer, along with the production tubing, in the manner illustrated in the instant invention, the length and structural integrity of the small power tubing 42 can be selected so that there is no danger of the various flow conduits exceeding their structural limitation. Furthermore, the use of relatively large and small diameter power tubings enables the entire lower power tubing to be removed from the well as may be required for inspection and servicing.

It is considered within the comprehension of this invention to employ a slim downhole pump 26 of a size which is received within the nominal diameter of the production tubing employed. Stated differently, it is considered within the comprehension of this invention to maintain the diameter of the housing 24' equal to the diameter of the production tubing at 24, and with the pump assembly being correspondingly scaled to meet this relative arrangement of sizes of the various components.

By the use of the present invention, a hydraulically actuated pump can be disposed downhole in extremely deep oil wells where the tubing weight is maintained at optimum values, because of the ability to use a small lightweight tubing at 42 respective to a heavy production tubing employed at 18, for example. The packer 44 can be located downhole at a location respective to the surface of the ground and to the producing formations, wherein the length and size of the smaller power fluid tubing 42 and production tubing 23 can be selected from both a cost and structural integrity viewpoint, thereby greatly lowering not only the initial cost of the tubing, but also enabling the production pump to be set at a lower depth than would otherwise be possible.

The present invention furthermore lowers the initial installation costs by reducing the amount of small tubing required in the well. The present invention provides means by which a plurality of zones may be effectively produced by the use of a single pump which can be set at an elevation which is always below the fluid level of the well.

Furthermore, the present invention enables the gas and fluid reservoir located below the packer to be produced at a rate which reduces the downhole pressure to an optimum value.

I claim:

1. In a borehole having a production zone from which hydrocarbon products flow into the lower extremity thereof; artificial lift apparatus for lifting the hydrocarbon products from the borehole, comprising: a fluid actuated pump means having a power fluid inlet, production fluid inlet, spent power fluid outlet, and a produced fluid outlet;

a seal bowl assembly, an upper power fluid string extending downhole in the borehole and connected to said seal bowl assembly, said upper power fluid string being of a size to form an annular flow path respective to the borehole wall; a vent means, a packer means; and, a produced fluid tubing within which said pump is housed;

means by which said production fluid inlet is flow connected to the lower extremity of the borehole such that the hydrocarbon products flow into the fluid actuated pump;

a lower power fluid tubing located within and coextensive with said produced fluid tubing and forming a lower annulus therebetween, opposite ends of said lower power fluid tubing being connected to said seal bowl assembly and to said power fluid inlet, respectively, such that power fluid flows through said upper power fluid string downhole to said seal bowl assembly, through said seal bowl assembly, into said lower power fluid tubing, and through said lower power tubing to said power fluid inlet of said pump;

means connecting said spent power fluid outlet and said produced fluid outlet to said produced fluid tubing so that spent power fluid and produced fluid flows into said produced fluid tubing;

said vent means being series connected between said produced fluid tubing and said seal bowl;

said packer being positioned in underlying relationship respective to said vent means and arranged to pack-off the produced fluid tubing from the borehole;

whereby power fluid flows down said upper power fluid string, through said seal bowl assembly, through said lower power fluid tubing to said pump, while spent power fluid and produced fluid flows into said lower annulus, through said packer, out through said vent means, and up the upper annulus where it can flow on to a gathering system.

2. The artificial lift apparatus of claim 1 wherein said pump has said production inlet located at the lower extremity thereof; said produced fluid string of tubing having means by which the lower end thereof sealingly receives the lower end of said pump such that production fluid inlet is disposed so that fluid can flow through said lower extremity of said produced fluid string and into the last said inlet.

3. The artificial lift apparatus of claim 1 wherein said seal bowl assembly is supported by said upper power fluid string, said seal bowl assembly having means by which it removably supports said lower power tubing.

4. The artificial lift apparatus of claim 3 wherein said upper power fluid string is of a larger inside diameter relative to the outside diameter of said lower power tubing, said upper power fluid string being of a size to support the weight presented by said seal bowl assembly, said vent means, said production fluid string, and said lower power fluid tubing.

5. The artificial lift apparatus of claim 1 wherein said seal bowl assembly is supported by said upper power fluid string, and seal bowl assembly having means by which it supports said lower power tubing;

said lower power tubing includes means by which an upper end thereof is removably supported by said seal bowl assembly, and the remaining end thereof being removably and sealingly engaged respective to said power fluid inlet;

the relative size of said power fluid string and said power fluid tubing being of sufficient difference in cross-sectional area to enable the last said tubing to be lifted through said power fluid string.

6. The artificial lift apparatus of claim 1, and further including a stab-in valve assembly; said stab-in valve assembly being connected in series relation respective to said produced fluid tubing; means forming a produced fluid flow passaageway through said stab-in valve assembly;

means forming a power fluid flow passageway through said stab-in valve assembly, said power fluid flow passageway having an inlet and an outlet end, means connecting said power fluid inlet of said pump to said outlet end of the last said flow passageway; means connecting the lower end of said lower power fluid tubing to said inlet end of said stab-in valve assembly;

and a valve means located within said stab-in valve assembly, the last said valve means being connected to be moved to the open position upon removal of the power tubing to thereby enable flow to occur laterally from said power fluid flow passageway into the borehole.

7. The apparatus of claim 6 wherein said stab-in valve assembly includes a lateral flow port, said valve means being located in said lateral flow port, means by which the lower end of said power tubing is sealingly seated upstream of said lateral flow port to thereby preclude flow therethrough; said valve means in said lateral flow port being a one way flow valve so that only outward flow occurs through said port.

8. Method of artifically lifting fluid from a borehole with a hydraulically actuated downhole pump comprising the steps of:

suspending a relatively small diameter power fluid tube from the lower end of a relatively large diameter power fluid tube, and supporting the upper end of the relatively large diameter tube from the surface of the earth;

connecting a hydraulically actuated production pump to the lower end of the small diameter power fluid tube, and enclosing said pump and said small diameter power fluid tube within a production tube;

venting the upper marginal end of the production tube into the borehole annulus, and packing off the borehole annulus at a location adjacent to and below the vented tube;

closing the annulus formed between the lower end of the production tubing and the production pump so that an annular flow path is formed, and connecting the pump inlet to formation fluid;

flowing formation fluid into pump inlet, flowing production fluid and spent power fluid up the lower annulus, through the packer, through the vent, up the borehole annulus, and to the surface of the ground, while flowing power fluid from the surface of the ground, through each of the power fluid tubes, and to the power fluid inlet of the production pump.

9. The method of claim 8, and further including the step of removably suspending the small diameter power fluid tube from the large diameter power fluid tube, and telescopingly placing the small diameter power fluid tube through said production tube, and removably receiving the lower end of said small diameter power fluid tube at the power fluid inlet of the pump so that the small diameter power fluid tube can be removed from the borehole, while the large diameter power fluid tube and the production tube remain within the borehole.

10. Artificial lift apparatus for lifting liquid from a borehole, comprising: a fluid actuated pump means having a power fluid inlet, production fluid inlet, spent power fluid outlet, and a produced fluid outlet;

a seal bowl assembly, an upper power fluid string extending downhole in the borehole and connected to said seal bowl assembly, said upper power fluid string being of a size to form an upper annular flow path respective to the borehole wall; a vent means, a packer means, and a produced fluid tubing within which said pump is housed;

means connecting the lower extremity of the borehole to said production fluid inlet such that any production fluid in the borehole flows through the fluid actuated pump;

a lower power fluid tubing located within said produced fluid tubing and forming a lower annulus therebetween, means connecting the opposite ends of said lower power fluid tubing, respectively, to said seal bowl assembly and to said power fluid inlet, respectively, such that power fluid flows through said upper power fluid string, downhole to said seal bowl assembly, through said seal bowl assembly, into said lower power fluid tubing, and through said lower power tubing to said power fluid inlet of said pump;

means connecting said spent power fluid outlet and said produced fluid outlet to said produced fluid tubing such that spent power fluid and produced fluid flows into said lower annulus;

means series connecting said vent means between said produced fluid tubing and said seal bowl assembly;

means positioning said packer in underlying relationship respective to said vent means such that the produced fluid tubing is packed off from the borehole;

whereby power fluid flows down said upper power fluid string, through said seal bowl assembly, into said lower power fluid tubing, and to said pump; while spent power fluid and produced fluid flows into said lower annulus, through said packer, out through said vent means, and up the upper annular flow path where it can be flow connected to a gathering system.

11. The artificial lift apparatus of claim 10 wherein said pump has said production inlet located at the lower extremity thereof; said produced fluid string of tubing includes means by which the lower end thereof sealingly receives the lower end of said pump such that said production fluid inlet is positioned to enable flow to occur through said lower extremity of said produced fluid tubing string and into the last said inlet.

12. The artificial lift apparatus of claim 10 wherein said upper power fluid string is of a large inside diameter relative to the outside diameter of said lower power tubing, said upper power fluid string being of a size to support the weight presented by said seal bowl assembly, said vent means, said production fluid string, and said lower power fluid tubing.

13. The artificial lift apparatus of claim 10 wherein said lower power tubing includes means by which an upper end thereof is removably supported by said seal bowl assembly, and the remaining end thereof is removably and sealingly engaged respective to said power fluid inlet;

the relative size of said power fluid string and said power fluid tubing being of sufficient difference in cross-sectional area to enable said lower power tubing to be lifted through said upper power fluid string.

14. The artificial lift apparatus of claim 10, and further including a gas escape valve, means connecting said escape valve in series relation respective to said produced fluid tubing;

an axial bore formed longitudinally through said escape valve, said power fluid tubing being received through said axial bore and forming an annular flow passageway therebetween;

a lateral port communicating said annular flow passageway with the lower borehole annulus, a check valve means in said lateral port for enabling gaseous flow to occur from said borehole annulus into the last said annular flow passageway.

15. The apparatus of claim 10, and further including a gas escape valve series connected within said production tubing at a location below said packer;

said escape valve comprising a main body having an axial passageway formed therethrough; a lateral flow passageway formed in said main body for connecting the last said axial passageway to the casing annulus;

said power fluid tubing being concentrically received through the last said axial bore, thereby leaving an annular flow passageway therebetween; and, check valve means positioned within said lateral flow passageway for controlling fluid flow from the casing annulus into the last said annular flow passageway.

* * * * *

UNITED STATES PATENT OFFICE

CERTIFICATE OF CORRECTION

PATENT NO. : 3,974,878

DATED : August 17, 1976

INVENTOR(S) : George K. Roeder and Raymond Hardy

It is certified that error appears in the above-identified patent and that said Letters Patent are hereby corrected as shown below:

Column 1, line 51, "strength" should read --length--.

Column 1, line 61, correct spelling of "borehole".

Column 3, line 3, "disclosed" should read --disposed--.

Column 3, line 57, correct spelling of "borehole".

Column 9, line 33, "and" should read --said--.

Signed and Sealed this

Twenty-fifth Day of January 1977

[SEAL]

*Attest:*

RUTH C. MASON
*Attesting Officer*

C. MARSHALL DANN
*Commissioner of Patents and Trademarks*